United States Patent [19]

Nowicki et al.

[11] Patent Number: 4,949,741

[45] Date of Patent: Aug. 21, 1990

[54] POWER TRANSMISSION

[75] Inventors: Harry J. Nowicki; Charles E. Oliveto, both of Searcy, Ark.

[73] Assignee: Vickers, Incorporated, Troy, Mich.

[21] Appl. No.: 295,485

[22] Filed: Jan. 10, 1989

[51] Int. Cl.[5] ..... F15B 13/044

[52] U.S. Cl. ..... 137/1; 137/625.65

[58] Field of Search ..... 137/1, 625.65

[56] References Cited

U.S. PATENT DOCUMENTS 4,373,697 2/1983 Phelps ..... 251/129.08

4,456,434 6/1984 El Ibiary ..... 137/625.65 X

FOREIGN PATENT DOCUMENTS 38128 10/1981 European Pat. Off. ..... 137/625.65

*Primary Examiner*—Gerald A. Michalsky

*Attorney, Agent, or Firm*—Barnes, Kisselle, Raisch, Choate, Whittemore & Hulbert

[57] ABSTRACT

A method of controlling spool shift speed in a solenoid operated hydraulic directional valve which includes a body, a spool slidably mounted in a bore in the body and operable to control hydraulic fluid flow, a force controlled solenoid adapted to be electrically energized by a constant current supply and a spring yieldingly urging the valve spool to a predetermined position, which method comprises applying a constant force by energizing the solenoid with a constant current to the spool valve which opposes the linearly increasing force of the spring thereby decelerating the shifting action of the spool.

1 Claim, 3 Drawing Sheets

POWER TRANSMISSION

This invention relates to power transmission and particularly to controlling the spool shift speed of a solenoid operated spool type hydraulic valve.

BACKGROUND AND SUMMARY OF THE INVENTION

In the control of hydraulic fluids, it has been common it utilize a spool valve wherein the spool is yieldingly urged to a predetermined position and one or more solenoids are provided to which a constant current supply is supplied in order to move the spool and control the hydraulic fluid.

One of the problems with respect to such a construction is that there is no control of the rate at which the sliding spool shifts and as a result pressure and flow shocks occur in the hydraulic system.

This is due in part to the fact that a standard solenoid has a force characteristic that increases as the spool approaches its full stroke position which in turn acts to accelerate the shifting action of the sliding spool.

It has been common to use a force controlled solenoid which provides a linear adjustable force by altering the current to the solenoid which in turn creates a force balance against the resisting spring for the purpose of proportionally controlling a spool position relative to its overall stroke.

Accordingly among the objectives of the present invention are to provide a method of decelerating the shifting action with a sliding spool hydraulic directional valve resulting in lesser amount of pressure and flow shock in the hydraulic system.

In accordance with the invention, it has been found that if the force controlled solenoid is energized by a constant current providing a constant force which is resisted by a variable force provided by the opposing spring in the solenoid valve, a resultant increasing resistant force level is achieved as the spring is compressed throughout the range of travel. This increasing force differential actions to slow the axial velocity of the spool so that the opening of the valve occurs at a slower rate.

In accordance with the invention, a method of controlling spool shift speed in a solenoid operated hydraulic directional valve which includes a body, a spool slidably mounted in a bore in the body and operable to control hydraulic fluid flow, a force controlled solenoid adapted to be electrically energized by a constant current supply and a spring yieldingly urging the valve spool to a predetermined position, which method comprises applying a constant force to the spool valve which opposes the variable force of the spring thereby decelerating the shifting action of the spool.

DESCRIPTION

Figure 1:
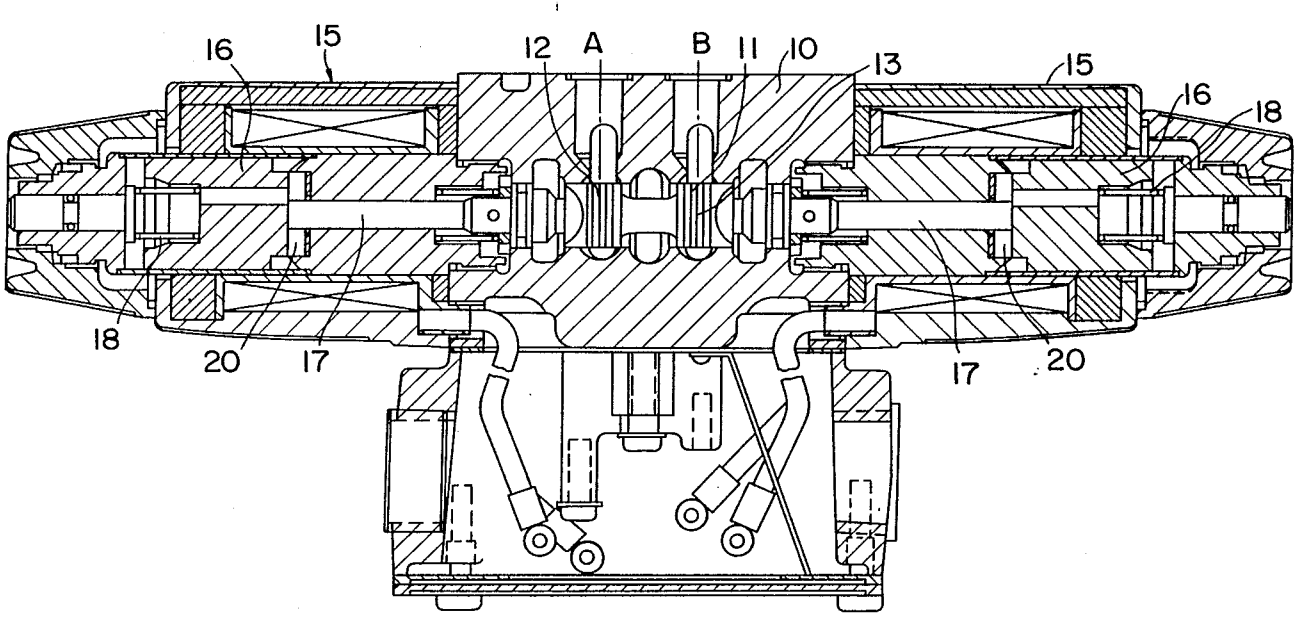
FIG. 1 is a longitudinal sectional view of solenoid valve operated in accordance with the invention.

Referring to FIG. 1, there is shown a conventional force controlled solenoid operated hydraulic valve which includes a body 10 having a slidable spool 11 with lands 12, 13 controlling the flow of fluid to outlets A, B. Solenoids 15 at each end of the body comprise an armature 16 that operates to shift a pin 17 an in turn the spool in a direction to control fluid flow through either ports A or B. Conventionally the solenoids 15 are supplied with a variable current to control spool position. Springs 18 are provided to control the initial position of the spool 11.

Figure 2:
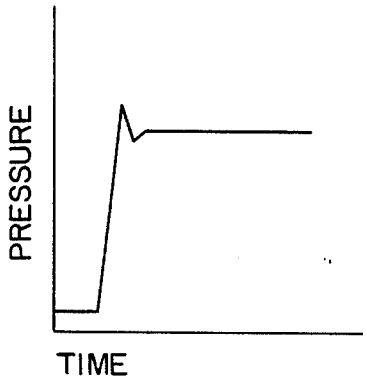
FIGS. 2, 3, 4 and 5 are charts of various curves.
Figure 3:
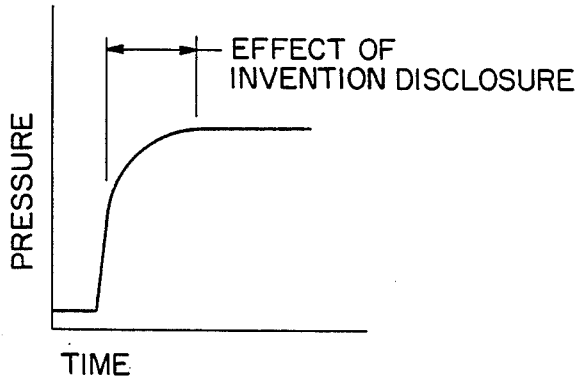
Figure 4:
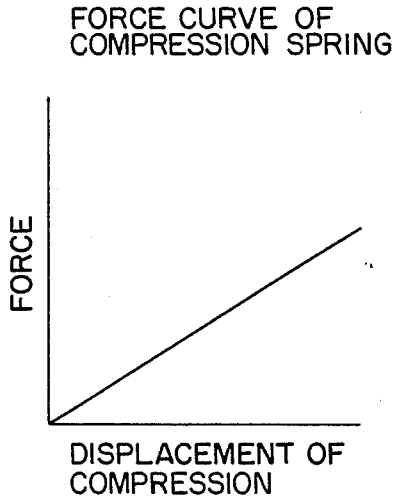
Figure 5:
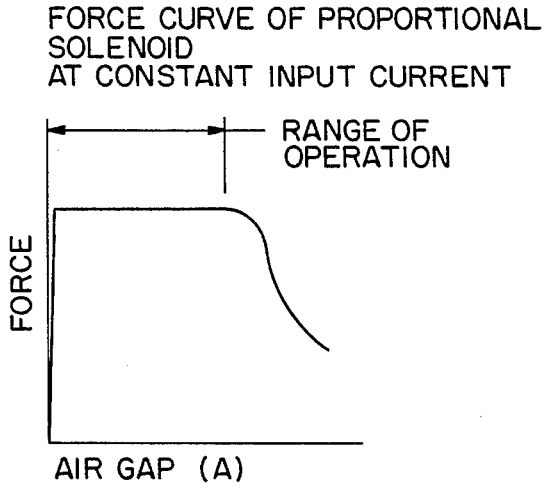

In accordance with the invention, a constant current is supplied to shift the spool. This creates a constant force, as shown in FIG. 5, which is resisted by variable force of one of the springs 18. As the constant current is applied, the air gap 20 beings to decrease and the spring 18 being to compress. This compression provides an ever-increasing resistive force opposing the constant force from the solenoid. The increasing force differential acts to slow the axial velocity of the spool 11, thereby causing the opening of the port at a slower rate. This resulting effect is shown in curves as shown in FIGS. 2 and 3. FIG. 4 is a curve of the ever-increasing compression of the spring.

In the mode where a standard solenoid valve is controlled by constant current it can be seen that there is provided an ever-increasing force verses air gap. As a result there is no deceleration of the spool and no control over system shock as can be seen in FIG. 2. By operating a force controlled solenoid valve with constant current, an ever-increasing force differential occurs versus the air gap closure yielding a deceleration of the spool. This results in the lessening of pressure and flow shocks in the hydraulic system, as can be seen in FIG. 3.

The invention is applicable to 2-way, 4-way, spring centered and spring off-centered valves.

We claim:

1. A method of controlling spool shift speed in a solenoid operated hydraulic directional valve which includes a body, a spool slidably mounted in a bore in the body and operable to control hydraulic fluid flow, a force controlled solenoid adapted to be electrically energized by a constant current supply and a spring yieldingly urging the valve spool to a predetermined position, which method comprises applying a constant force by energizing the solenoid with constant current to the spool valve which opposes the variable force of the spring thereby decelerating the shifting action of the spool.

* * * * *